United States Patent [19]

Goff, Jr.

[11] 4,136,861

[45] Jan. 30, 1979

[54] PAPER GUIDE MEANS FOR REVERSE FEED SHEET PAPER SEPARATION DEVICE

[75] Inventor: Willie Goff, Jr., Austin, Tex.

[73] Assignee: International Business Machines Corporation, Armonk, N.Y.

[21] Appl. No.: 838,434

[22] Filed: Sep. 30, 1977

[51] Int. Cl.[2] ..... B65H 3/30

[52] U.S. Cl. ..... 271/22; 271/113

[58] Field of Search ..... 271/22, 21, 113, 19, 271/20, 23-25

[56] References Cited

U.S. PATENT DOCUMENTS

| | | | |
|---|---|---|---|
| 3,857,558 | 12/1974 | Patel | 271/22 |
| 3,944,215 | 3/1976 | Beck | 271/22 |

*Primary Examiner*—Richard A. Schacher
*Attorney, Agent, or Firm*—Keith T. Bleuer

[57] ABSTRACT

Mechanism for separating the uppermost pliant sheet of a stack of such sheets from the stack including a rotatable friction drive wheel effective on the longitudinal center line of the uppermost sheet for initially moving the sheet rearwardly, and a pair of downwardly tapered posts at the rear face of the stack and on opposite sides of the center line which cause the uppermost sheet to bow upwardly away from the stack particularly on its side edges for thereby effectively separating the sheet from the stack and allowing it to be driven subsequently in the forward direction to free it completely from the stack.

8 Claims, 8 Drawing Figures

PAPER GUIDE MEANS FOR REVERSE FEED SHEET PAPER SEPARATION DEVICE

BACKGROUND OF THE INVENTION

The invention relates to sheet paper separators for separating an end sheet of a stack of pliant sheets from the stack and more particularly to such separators which are generally referred to as "reverse bucklers" in which the end sheet is initially driven rearwardly against abutment means causing the sheet to buckle along longitudinal lines prior to a driving of the sheet in the forward direction to completely separate it from the stack.

Prior hereto, such reverse buckling paper separators have commonly included a vertical abutment which is essentially normal to the horizontal plane of the end, and more particularly the uppermost, sheet of the stack; and the uppermost sheet is driven rearwardly against this abutment so as to stop the sheet and such that continued drive force on the uppermost sheet results in the sheet buckling substantially the same along all longitudinal lines. Such reverse buckling separators also commonly have included sheet retainers for holding the sheets at the front edges of the sheets and which are cleared by the uppermost sheet as it is driven forwardly after this buckling action to clear it completely from the stack.

SUMMARY OF THE INVENTION

It is an object of the invention to provide an improved sheet paper separator of the reverse buckler type which is so constructed as to more consistently and more completely separate the uppermost pliant sheet in its rearward movement from a stack of such sheets so that top sheets can be very consistently separated from a stack by moving them rearwardly. More particularly, it is an object of the invention to provide means effective adjacent the side edges of the uppermost sheet and means for driving the sheet substantially along its longitudinal center line so that the buckling of the sheet is quite different along longitudinal lines of the sheet, from the longitudinal center line of the sheet to its side edges. More particularly, the buckling along the side edges of the sheet should be very pronounced compared to any buckling along the longitudinal center line so as to obtain the improved sheet separating action in rearward movement, prior to a subsequent driving of the sheet off of the stack in the forward direction.

In a preferred form, the invention includes a rotatable friction driving wheel on the longitudinal center line of the uppermost pliant sheet of a stack and a pair of posts separated substantially from the center line and preferably located closer to the side edges of the uppermost sheet of the stack. The posts include downwardly tapering frusto-conical portions which depress particularly the front edge of the uppermost sheet at the spaced points on the rear sheet edge in contact with the spaced posts as the sheet travels down these portions so that the side edges of the sheet have very pronounced bows in them upon continued driving of the sheet in the rearward direction for reliably initially separating the uppermost sheet from the stack. The driving wheel is then used to drive the uppermost sheet forwardly to fully separate it from the stack.

DESCRIPTION OF THE PREFERRED EMBODIMENT

Figure 1:
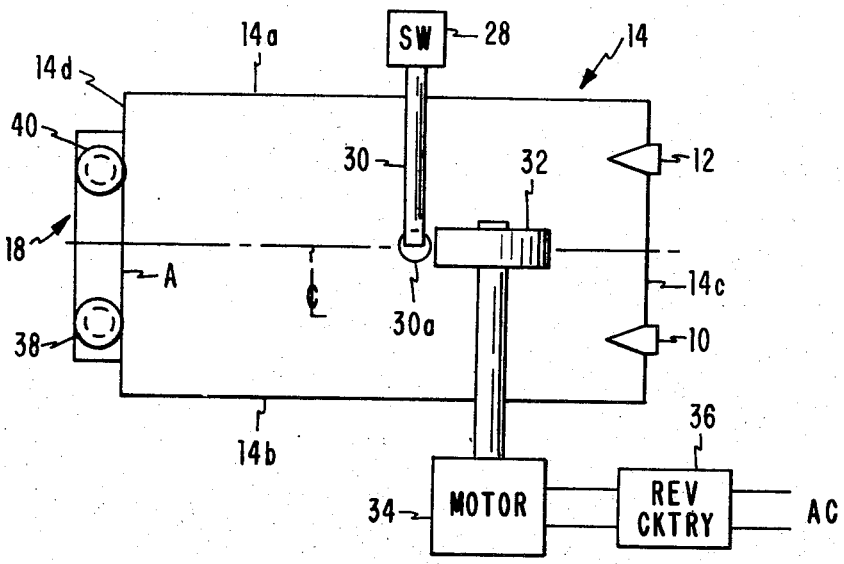
FIG. 1 is a top plan view of mechanism according to the invention for separating the uppermost sheet of a stack of pliant sheets from the stack.
Figure 2:
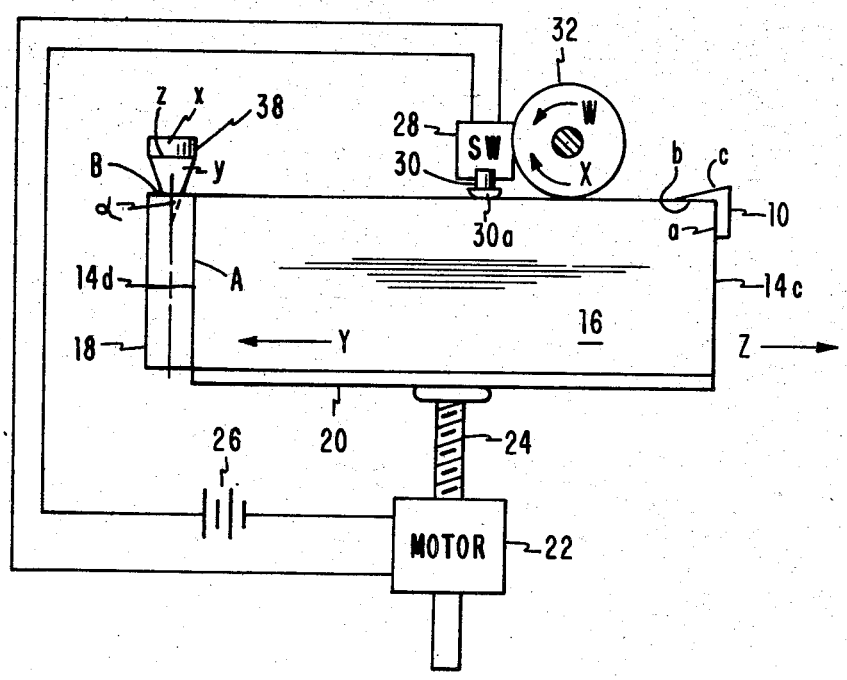
FIG. 2 is a side elevational view of the mechanism shown in FIG. 1.

Referring to FIGS. 1 and 2, the paper guide means of the invention may be seen to include a pair of snubbers 10 and 12 on a forward face **14*c* of a stack 14 of pliant paper sheets 16 and an abutment 18 on the other or rear face 14*d* of the paper stack 14. Both the abutment 18 and the snubbers 10 and 12 are fixed so as to hold the paper stack 14 in a vertical column. For this purpose, the snubbers 10 and 12 are each provided with a vertical inside surface a, and the abutment 18 is provided with an inside vertical surface A in contact with rear stack face 14*d*. Each of the snubbers 10 and 12 is furthermore provided with a horizontally extending surface b with which the upper sheet of the stack 14** makes contact and a downwardly tapering upper surface c.

A paper table 20 supports the paper stack 14; and the table 20 and stack 14 are supported by a drive motor 22, which is fixed to any suitable stationary support, and a screw 24 disposed within the motor 22 and abutting a lower surface of the table 20. The motor 22 is electrically connected to a battery 26 and a switch 28 for at times actuating the motor 22 to raise the table 20 and paper stack 14. The switch 28 is actuated by a feeler arm 30 that has a rounded portion **30*a* that is in contact with the uppermost sheet of the stack 14**.

A friction drive wheel 32 is in engaging contact with the uppermost sheet of the paper stack 14 on the longitudinal center line CL of the sheet, and the wheel 32 is driven in opposite directions W and X by a motor 34. Reversing circuitry 36 is connected to the motor 34 and to any suitable source of alternating current.

A pair of paper guide posts 38 and 40 are affixed on the abutment 18. Each of the posts 38 and 40 includes a cylindrical portion x and a downwardly tapering frusto-conical portion y that extends along the rear face **14*d* of the stack 14. The abutment 18 has an upper surface B to which in particular the frusto-conical portions y of the posts 38 and 40 are affixed. It will be noted that the surface B of the abutment 18 is below the plane of the uppermost sheet 16 of the paper stack 14 and that the ridge z on each of the posts 38 and 40** forming the meeting edges of the portions x and y is above the uppermost sheet 16 in the stack 14 so that frusto-conical portions y are in the plane of the uppermost sheet 16 of stack 14.

In operation, the motor 34 is initially energized so as to drive the friction wheel 32 in the direction X. The friction wheel 32 thus moves the uppermost sheet 16 of the stack 14 in the rearward direction Y and into contact with the frusto-conical portions y of the posts 38 and 40, and the sheet buckles and bows between the friction wheel 32 and the posts 38 and 40 as will be subsequently described in greater detail. The uppermost sheet thus is moved in the direction Y so as to completely move it out of engagement with the snubber surfaces b and with the snubbers 10 and 12. The motor 34 is then reversed using the reverse circuitry 36 so as to rotate the friction wheel 32 in the direction W. The sheet is then propelled forwardly in the direction Z so as to feed it out from the paper stack 14 for any desired ultimate use. Subsequent sheets are fed from the stack 14 in the same manner, and the stack 14 is always maintained with its uppermost sheet 16 in the vertical position as shown in FIG. 2 and in contact with and at the same level as the surfaces b of the snubbers 10 and 12 due to the action of the switch 28 and motor 22. As the sheets tend to be depleted from the stack 14, the feeler arm 30 travels downwardly slightly with the depleting stack 14 and actuates the motor 22 so as to cause the screw 24 to move the table 20 upwardly and bring the uppermost sheet of the stack 14 back to the position in which it is illustrated in FIG. 2. During all of this operation, the uppermost sheet 16 is always above the uppermost surface B of the abutment 18 and is in alignment with the frusto-conical surfaces y of the posts 38 and 40.

As is illustrated in FIG. 1, the posts 38 and 40 are intermediate the center line CL of the stack 14 and the side faces 14*a* and 14*b* of the stack 14 and in fact are preferably closer to the stack side faces 14*a* and 14*b* than to the center line, and the posts 38 and 40 are both out of line with the wheel 32 in directions Z and Y. Thus, as the friction wheel 32 is driven in the direction X, the sheets 16 cam downwardly on the frusto-conical post portions y and buckle as shown in FIGS. 3–8. The uppermost sheet 16 of the stack 14 is shown in FIGS. 3–8 with equally spaced transverse lines 16*a*–16*k* and with equally spaced longitudinal lines 16*v*, 16*w*, 16*x*, 16*y* and 16*z*. These lines have been shown for the purpose of rendering the buckling and bowing of the uppermost sheet 16 of the stack 14 clear as the sheet is moved reversely in the direction Y prior to a movement forwardly in the direction Z to finally remove the sheet from the stack 14.

Figure 3:
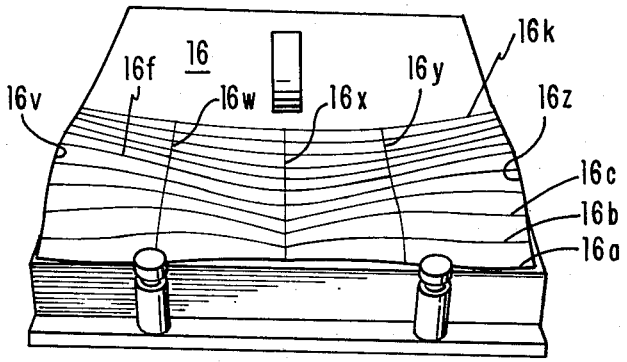
FIG. 3 is a front perspective view of the stack of sheets showing the uppermost sheet driven rearwardly for a predetermined initial distance in an initial separating movement from the stack.
Figure 5:
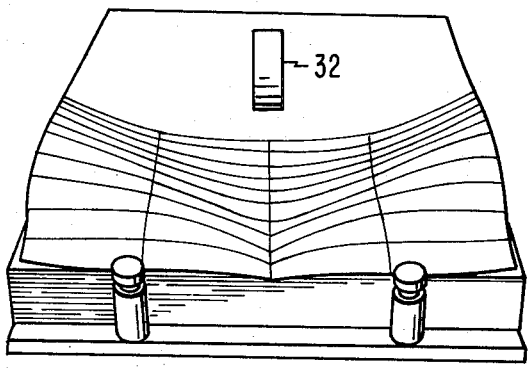
FIGS. 5 and 7 are front perspective views of the sheet stack and uppermost sheet corresponding to FIG. 3 and showing the uppermost sheet respectively driven rearwardly at a medium distance and at its final distance longitudinally on the stack of sheets.
Figure 7:
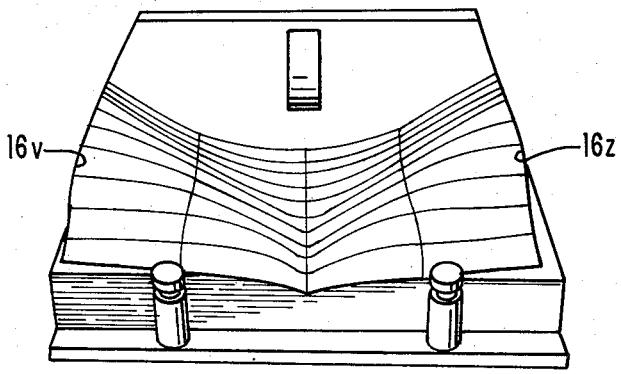
Figure 4:
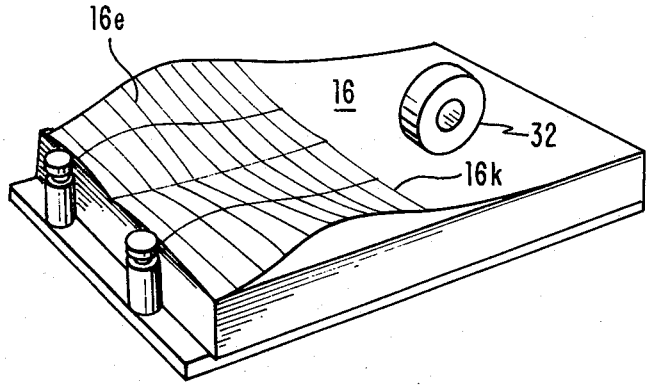
FIG. 4 is a perspective view corresponding to FIG. 3 showing the uppermost sheet driven rearwardly for said predetermined initial distance, the view being taken from a side and front corner of the stack of sheets.
Figure 6:
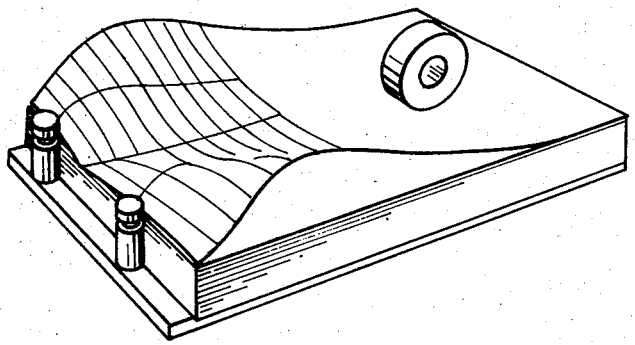
FIGS. 6 and 8 are corner perspective views of the stack of sheets and uppermost sheet corresponding to FIG. 4 and respectively showing the uppermost sheet in the same positions as in FIGS. 5 and 7.
Figure 8:
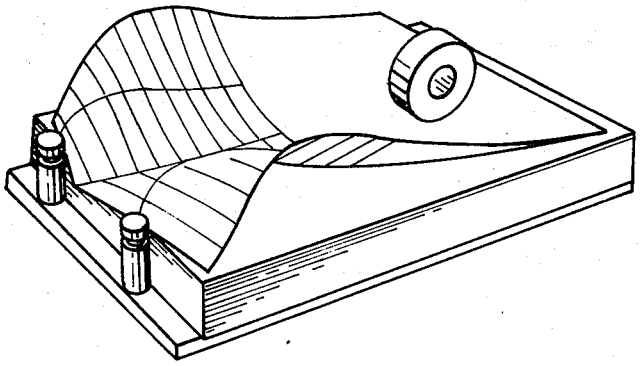

Initially, as the uppermost sheet 16 of the stack 14 is moved rearwardly in direction Y to contact the frusto-conical portions y of the posts 38 and 40 and with still further movement in direction Y, such as of 0.30 inch (7.6mm) altogether, it is apparent from FIGS. 3 and 4 that the uppermost sheet 16 of the stack 14 buckles and bows particularly at its side edges on lines 16*v* and 16*z* and that the longitudinal center of the sheet on line 16*x* remains nearly flat during this operation. As the uppermost sheet 16 moves still farther under the actuation of the wheel 32 rotating in direction X, the sheet 16 buckles and bows still additionally, particularly at its side edges, while the center of the uppermost sheet 16 (on line 16*x*) still remains quite flat. This is shown particularly by FIGS. 5 and 6 which show an overall movement of the uppermost sheet 16 for 0.50 inch (12.7mm) from its original position and FIGS. 7 and 8 which show continued movement of the uppermost sheet 16 for 0.75 inch (19mm) altogether from original position. Due to this buckling and bowing, as is apparent from FIG. 7, the edges of the uppermost sheet 16 have retracted considerably from the side edges of the stack 14, and the rear edge of the uppermost sheet delineated by the transverse line 16*a* has retracted considerably from the rear face 14*d* of the stack 14. The top sheet 16 is also bowed out of contact with the next lower sheet in the stack 14 as seen particularly in FIG. 8. The top sheet 16 is thus substantially free of the remainder of stack 14 for a movement individually off of the stack. At this time, the uppermost sheet 16 has separated completely from the snubbers 10 and 12, and the wheel 32 is reversed due to the action of drive motor 34 so as to rotate in direction W. The uppermost sheet 16 of the stack 14 then moves along the surfaces c of the snubbers 10 and 12 and moves off of the stack 14 in the direction Z to be completely separated from the stack 14 for its intended end use.

The initial separation of the uppermost sheet 16 from the stack 14 during reverse movement in direction Y and as shown by FIGS. 3–8 is achieved by the differential bowing of the sheet, differently along the various longitudinal lines 16*v*–16*z* of the sheet, rather than with a bowing which is uniform from one side edge to the other side edge of the sheet as in the prior art. There is some bowing along the intermediate longitudinal lines 16*w* and 16*y*, and the bowing along these longitudinal lines is intermediate the large amount of bowing along the exterior lines 16*v* and 16*z* and the lack of bowing on the longitudinal center of the sheet. This differential bowing along the lines 16*v*, 16*w*, 16*y* and 16*z* is due to the fact that the frusto-conical portions y of the posts 38 and 40 taper downwardly and are located directly opposite the plane of the uppermost sheet 16 of stack 14 and the fact that the posts 38 and 40 are spaced apart and from the center line CL which runs through the center of the wheel 32. The frusto-conical surfaces y of the posts 38 and 40 cam downwardly and depress spaced points on the rear edge of the uppermost sheet 16 of the stack 14 below the plane of the sheet and thus cause other parts of the uppermost sheet 16 of the stack 14 to bow and bend upwardly, particularly along the lines 16*v*, 16*w*, 16*y* and 16*z* as shown in FIGS. 3–8. Since the uppermost sheet 16 has a substantially flat configuration along its longitudinal center line (along lines CL and 16*x*) while the sheet is bowed upwardly along the other longitudinal lines 16*v*, 16*w*, 16*y* and 16*z*, the uppermost sheet is in the form of a partial column or cylinder from its rear end (along line 16*a*) substantially to the wheel 32 so that the uppermost sheet has substantially more stiffness longitudinally than the sheet has in planar form. The friction roll 32 in driving the uppermost sheet rearwardly in direction Y thus is more effective to drive the sheet downwardly along the frusto-conical portions y of the posts 38 and 40 than would be the case if the sheet were in plane form. The frusto-conical portions y thus have a multiple action, namely, of providing the differential bowing along lines 16*v*, 16*w*, 16*y* and 16*z* due to their spaced location and adjacency to the stack side faces 14*a* and 14*b*, and the bowing stiffens the uppermost sheet 16 so that the wheel 32 may drive the sheet even farther down the frusto-conical post portions that increases the bowing. The drive wheel 32 as shown in FIG. 2 is located closer to the forward face 14*c* than to the rear face 14*d* of the stack 14, and thus the column-like configuration of the uppermost sheet 16 is substantially longer and stiffer than would be the case if the drive wheel 32 were located closer to the posts 38 and 40.

Although the inverted conical portion y of each of the posts 38 and 40 may vary in angle while providing satisfactory operation, nevertheless, it is preferred that the angle $\alpha$ shown in FIG. 2 of the inverted conical portion y shall preferably be between 15 degrees and 30 degrees.

I claim:

1. A separator for separating the pliant sheet on a first end of a stack of such sheets from the stack, said first end and also a second opposite end of the stack each being defined by a single one of said sheets and a face of said stack being defined by aligned edges of the sheets in said stack, said separator comprising:

a pair of stationary posts positioned at said face of the stack and each of the posts including a conical portion in alignment with said pliant sheet on said first end of the stack and tapering to smaller diameter along said face of the stack toward said second end of the stack, and sheet drive means operable centrally of said pliant sheet on said first end of the stack to move this sheet toward and into contact with said conical post portions to thereby cause points on the edge of the sheet contacting said conical post portions to be cammed thereby toward said second end of the stack whereby the pliant sheet on said first end of the stack remains substantially in contact with the stack centrally of the sheet in the direction of its movement and is bowed away from the stack at opposite edges of the sheet.

2. A separator for separating an uppermost pliant sheet on a stack of such sheets from the stack, comprising:

a pair of stationary posts positioned at a rear face of the stack and each of the posts including a conical portion in alignment with said uppermost sheet on the stack and tapering to smaller diameter along said rear face of the stack toward the bottom of the stack, and sheet drive means operable centrally of said uppermost sheet to move the sheet rearwardly toward said posts and to thereby cause points on the rear edge of the sheet to be cammed by said conical post portions toward the bottom of the stack whereby the uppermost sheet remains substantially in contact with the stack centrally of the sheet in the direction of its movement and is bowed away from the stack at opposite edges of the sheet.

3. A sheet separator as set forth in claim 1, each of said posts having its conical surface separated from said rear face of the stack of sheets and from the uppermost sheet of the stack prior to a movement as aforesaid of said uppermost sheet in the rearward direction.

4. A sheet separator as set forth in claim 1, said sheet drive means including a friction wheel effective substantially along the longitudinal center line of said uppermost sheet of the stack and said posts being located on opposite sides of said longitudinal center line and intermediate the center line and opposite side faces of the stack.

5. A sheet separator as set forth in claim 1, said conical post portions having their external surfaces extending at an angle from 15 degrees to 30 degrees from cylindrical.

6. In a reverse buckler sheet separator wherein the uppermost sheet of a stack of sheets is first moved rearwardly against rear stop means to thereafter buckle the uppermost sheet and thereafter the uppermost sheet is separated from the stack by forward movement thereof, the improvement comprising:

rear stop means comprising at least two spaced posts each of which includes an inverted conical surface spaced from the rear edge of the uppermost sheet, said conical surfaces operating on the uppermost sheet during reverse movement thereof to cause the side edges of the uppermost sheet to buckle without a substantially buckling of the uppermost sheet along its longitudinal center.

7. In a method of separating the pliant sheet on a first end of a stack of such sheets from the stack, said first end and also a second opposite end of the stack each being defined by a single one of said sheets and a face of said stack being defined by aligned edges of the sheets in said stack, the steps which comprise:

moving the sheet on said first end of the stack in one direction across the stack by engaging the sheet at a place intermediate opposite edges thereof and thereby applying propelling force on the sheet, and moving the leading end of this sheet as it travels in said direction along said face of the stack toward said second stack end at two spaced points which are substantially intermediate the line of movement of the sheet passing through said engaged place on the sheet whereby the sheet remains substantially in contact with the stack along said line of movement and is buckled away from the stack along side edges of the sheet at sides of said line of movement.

8. In a method of longitudinally moving an uppermost pliant sheet from a stack of such sheets, the steps which comprise:

engaging the uppermost sheet along its longitudinal center line at a place closer to its trailing edge than to its leading edge in such movement and thereby moving the sheet in one direction longitudinally, and depressing the leading edge of the sheet during such movement at a pair of points located substantially intermediate the longitudinal center line of the sheet and opposite side edges of the sheet so as to thereby cause the sheet to remain substantially in its original plane on the top of the stack along said center line and cause the sheet to bow at places at the sides of the center line and along the side edges of the sheet and thus cause the uppermost sheet to separate from the sheet just below in the stack, and then moving the uppermost sheet in the opposite direction off of the stack of sheets.

* * * * *